United States Patent [19]

Barnett

[11] 4,282,458

[45] Aug. 4, 1981

[54] WAVEGUIDE MODE COUPLER FOR USE WITH GYROTRON TRAVELING-WAVE AMPLIFIERS

[75] Inventor: Larry R. Barnett, Alexandria, Va.

[73] Assignee: The United States of America as represented by the Secretary of the Navy, Washington, D.C.

[21] Appl. No.: 129,301

[22] Filed: Mar. 11, 1980

[51] Int. Cl.[3] ..... H01J 25/00; H01P 1/163

[52] U.S. Cl. ..... 315/4; 315/5; 333/21 A; 333/251

[58] Field of Search ..... 315/4, 5; 333/109, 113, 333/21 R, 21 A, 251

[56] References Cited

U.S. PATENT DOCUMENTS 2,960,670 11/1960 Marcatili ..... 333/113

*Primary Examiner*—Paul L. Gensler

*Attorney, Agent, or Firm*—R. S. Sciascia; William T. Ellis; Alan P. Klein

[57] ABSTRACT

A rectangular waveguide to circular waveguide coupler and vice versa. The coupler includes a first section of circular waveguide spaced by a gap from a reflective-plane conducting wall, the latter having a hole for passage of an electron beam if the coupler is used in a traveling wave tube, and a second section of circular waveguide disposed external to, and coaxial with, at least a portion of the first waveguide section and extending to the wall to provide a conductive boundary surrounding the gap. The region between the first and second waveguide sections forms an input port of the coupler; the first waveguide section forms the output port of the coupler. Electromagnetic waves in a $TE_{01}$ coaxial waveguide mode are applied to the input port from a rectangular waveguide supporting the dominant $TE_{10}$ mode. The second waveguide section has a cut-off determining dimension $r_e$ proportioned to support both the $TE_{01}$ and $TE_{02}$ circular electric modes in the region of the gap at the frequency of the applied waves. The first waveguide section has cut-off determining dimensions $r_1$ proportioned to support the circular electric $TE_{01}$ mode to the exclusion of all higher-numbered circular electric modes at the frequency of the applied waves.

7 Claims, 9 Drawing Figures

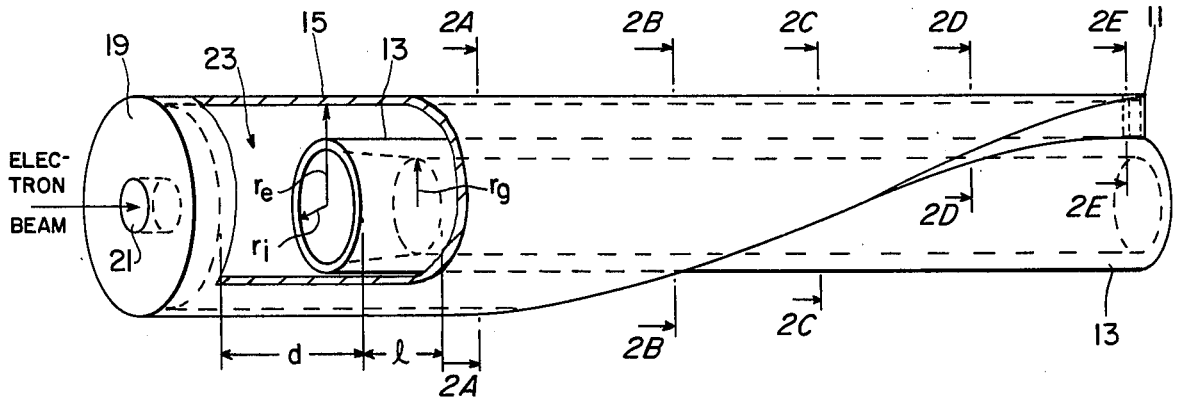
FIG. 1
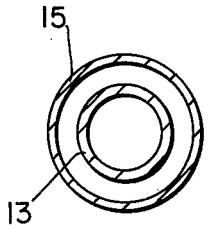
FIG. 2A
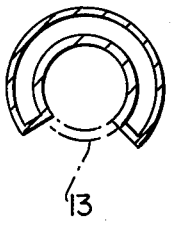
FIG. 2B
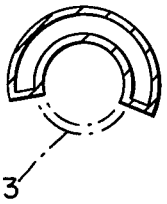
FIG. 2C
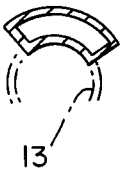
FIG. 2D
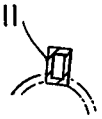
FIG. 2E
FIG. 3A
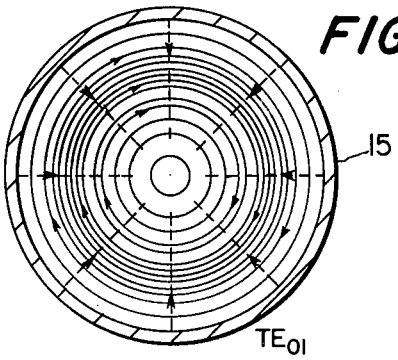
FIG. 3B
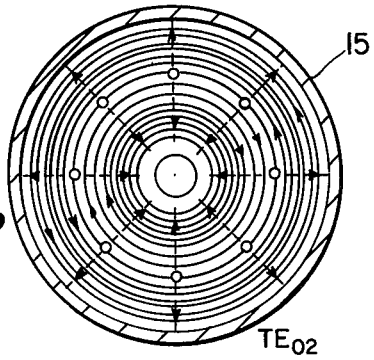

WAVEGUIDE MODE COUPLER FOR USE WITH GYROTRON TRAVELING-WAVE AMPLIFIERS

BACKGROUND OF THE INVENTION

This invention relates generally to waveguide couplers, and more particularly to a coupler between a rectangular waveguide and circular waveguides.

Gyrotron traveling-wave amplifiers, such as disclosed in U.S. Pat. No. 4,224,576 issued Sept. 23, 1980 to V. L. Granatstein et al., comprise an electron gun whose electron beam passes through a circular waveguide which is proportioned to support the circular $TE_{01}$ mode to the exclusion of all of the higher-numbered circular modes. Microwave energy is introduced into the waveguide in the same direction as the electron beam by means of a coupler positioned in the gap between the electron gun and the circular waveguide. The input to the coupler is a rectangular waveguide supporting the dominant $TE_{10}$ mode. A solenoidal winding surrounding the electron gun and the circular waveguide produces a longitudinal magnetic field whose strength increases in the gap region. Desirably, the width of the gap is kept small in order to provide an optimum magnetic field profile.

In the past, the coupler was unable to provide efficient coupling of microwave energy over a wide bandwidth because of the constraints placed upon it by the dimensions of the gap. In a practical embodiment of the gyrotron traveling-wave amplifier at 35 GHz the gap is only 0.7 inches wide. Typical slot or multi-hole directional couplers disclosed, for example, in the text *Microwave Engineering* by A. F. Harvey, Acedemic Press, 1963, have a good bandwidth but in order to provide efficient (zero-decibel) coupling they must be many wavelengths long. U.S. Pat. No. 2,960,670 issued to Marcatelli on Nov. 15, 1960, discloses a circular mode directional coupler of wideband and compact design. The drawback is, that in order to use it, a very long rectangular-to-circular taper must be used (many wavelengths long) and the rectangular-to-circular taper would have to be in the position of the electron gun in order to couple microwaves in the proper direction.

SUMMARY OF THE INVENTION

It is therefore one object of the present invention to provide efficient microwave coupling between circular and rectangular waveguides.

It is another object of the present invention to provide efficient microwave coupling in a short physical length from a rectangular to a circular waveguide in a gyrotron traveling-wave amplifier.

It is a further object of the present invention to efficiently couple microwave energy, in a short physical length, over a wide bandwidth, from a rectangular to a circular waveguide in a gyrotron traveling-wave amplifier.

The objects of the present invention are achieved by a rectangular waveguide-to-circular waveguide coupler or vice versa, especially useful for a gyrotron traveling-wave (GYRO-TWT) amplifier making it possible to provide efficient microwave coupling in a short physical length over a wide bandwidth. The coupler includes a first section of hollow conductive waveguide spaced by a gap from a reflective-plane conducting wall, the latter having a hole for passage of an electron beam when used in a GYRO-TWT amplifier, and a second section of hollow conductive waveguide disposed external to, and coaxial with, at least a portion of the first waveguide section and extending to the wall to provide a conductive boundary surrounding the gap. The region between the first and second waveguide sections forms an input port of the coupler; the first waveguide section forms the output port of the coupler. Electromagnetic waves in a waveguide mode are applied to the input port. The second waveguide section has a cut-off-determining dimension $r_e$ proportioned to support first and second distinct waveguide modes in the region of the gap at the frequency of the applied waves. The first waveguide section has cut-off-determining dimension $r_i$ proportioned to support the first mode to the exclusion of the second mode at the frequency of the applied waves.

The foregoing as well as other objects, features and advantages of the present invention will become more apparent from the following detailed description when taken in conjunction with the appended drawings.

BRIEF DESCRIPTION OF THE DRAWINGS

FIG. 1 is a perspective cutaway view of an embodiment of a coupler in accordance with the invention.

FIGS. 2*a* through 2*e* are successive transverse cross-sectional views of a mode converter utilized in the coupler of FIG. 1.

FIGS. 3*a* and 3*b* are schematic illustrations, given by way of explanation, of certain mode field patterns helpful for an understanding of the operation of the coupler of FIG. 1.

DESCRIPTION OF THE PREFERRED EMBODIMENT

Figure 4:
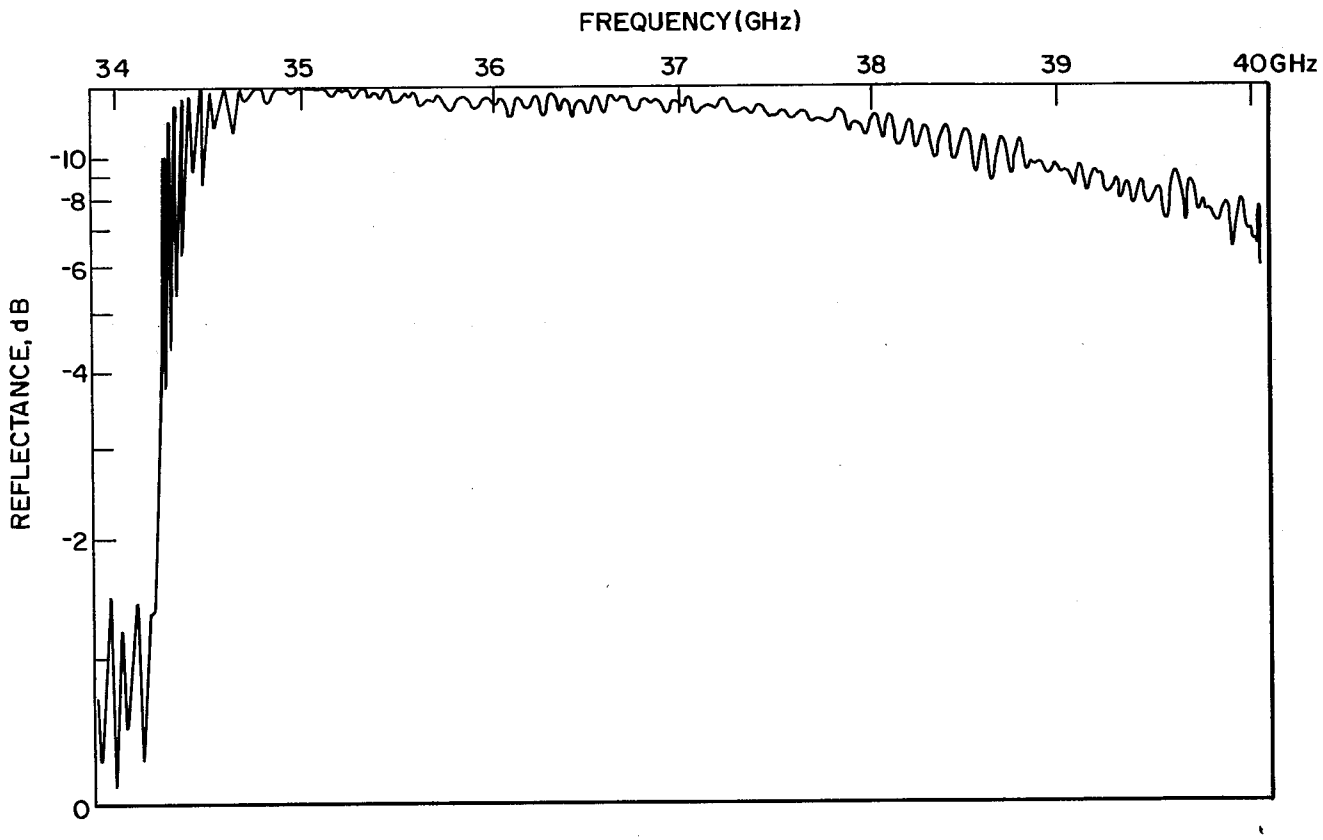
FIG. 4 is a graph illustrating reflectance loss at certain frequencies.

FIG. 1 is a perspective view of a coupler, in accordance with the invention, whose structural geometry is compatible with the requirements of the GYRO-TWT amplifier. The invention will be described as it applies to a GYRO-TWT amplifier since it is especially useful therein. As a waveguide coupler in a GYRO-TWT amplifier, the reflecting wall 19 has a hole therein for admittance of an electron beam; the hole is unnecessary in other coupling applications. FIG. 1 may be conveniently considered as comprising two major sections; the first is a rectangular-to-circular taper for converting wave energy from the rectangular waveguide 11 (the source of microwave energy) into circular mode energy; the second is the coupler itself for coupling the circular mode energy to the circular waveguide 13 positioned adjacent to the electron gun.

Considering the first section, namely the rectangular-to-circular taper, this is in essence a mode converter of the type disclosed in the text *Principles and Applications of Waveguide Transmission* by G. C. Southworth, D. Van Nostrand and Co., 1950, at p. 363. The converter progressively varies the transverse shape of the rectangular waveguide 11 such that that boundary between the rectangular guide 11 and the circular guide 13 is gradually flared to the transverse shape of a double pipe coaxial guide as indicated by FIGS. 2*a* through 2*e* of the drawings.

The device to the left of the converter is the coupler itself, which comprises the guide 13 and a hollow conductive waveguide 15 of circular cross-section coaxially disposed with respect to the guide 13. The guide 13 may be supported in its axial position within guide 15 by the mode converter.

A reflecting-plane conducting wall 19 is transversely arranged adjacent to, and spaced by the above-mentioned gap from, the end of the guide 13. A hole 21 in the wall 19 permits entry of the electron beam from the electron gun (not shown) positioned to the left behind the wall. The guide 15 projects beyond the end of the guide 13 to the wall 19 to provide a conductive boundary around the guide 13 and around the gap 23.

The two ports of the coupler are designated as follows: the input port is the ring-like region between the guide 13 and the internal boundary of the guide 15, and the output port is the guide 13. The guide 13 is proportioned to support the circular electric $TE_{01}$ mode to the exclusion of all of the higher-numbered circular electric modes.

In operation, electromagnetic energy enters at the right-hand end of the rectangular guide 11 exclusively in the $TE_{10}$ dominant mode and is gradually deformed in the mode converter to the $TE_{01}$ coaxial mode to continue propagating along the double pipe coaxial guide to the left. The guide 15 in the region of the gap 23 is proportioned to support both the $TE_{01}$ and $TE_{02}$ circular electric modes, to the exclusion of all of the higher numbered circular electric modes, as will be explained hereinafter. When the energy propagating to the left along the double pipe coaxial guide reaches the input port of the coupler and enters the gap 23 wherein both the $TE_{01}$ and $TE_{02}$ modes can be supported, the wave energy immediately comprises both of these modes. The electric field pattern therefore immediately at the right-hand end of the gap 23 may be considered as a superposition of the $TE_{01}$ electric field pattern upon the $TE_{02}$ electric field pattern.

FIG. 3*a* represents the electric field pattern of the $TE_{01}$ mode. FIG. 3*b* represents the electric field pattern of the $TE_{02}$ mode. It may be seen that in passing from the center of the guide 15 to the circumference along the radius there is no reversal in the polarity of the electric field components (the solid concentric circles) for the $TE_{01}$ mode, whereas there is a reversal in the polarity of the electric field components (and thus an electric field null exists) for the $TE_{02}$ mode.

The radius $r_i$ of the internal guide 13 is determined so that the conductive boundary of guide 13 coincides with the electric field null of the $TE_{02}$ mode.

As is well known in the art, every electromagnetic mode, at a given frequency, requires a waveguide of a certain minimum transverse dimension in order for it to be propagated. Conversely a round waveguide in a given radius will support only those frequencies, in the particular modes of interest, which are above a certain minimum frequency (whose wavelength is known as the cut-off wavelength). Lower frequencies having larger wavelengths will not be supported by the waveguide. Parametric expressions relating the cut-off wavelength, the radius of the circular waveguide, and a function of the electromagnetic mode, are well known in the art.

Thus, it is known that the cut-off wavelength for the $TE_{03}$ mode is $$\lambda_c = 2\pi r/10.17$$

for the $TE_{02}$ mode $$\lambda_c = 2\pi r/7.02$$

and for the $TE_{01}$ mode $$\lambda_c = 2\pi r/3.83$$

where $\lambda_c$ is the cut-off wavelength, r is the radius of the waveguide, and the denominator in each instance is the appropriate Bessel function root for the particular transverse electric mode involved. Keeping the operating frequency range in mind, it is therefore relatively simple with these parametric relationships to design the waveguides 13 and 15 in accordance with the requirements specified above. Thus the radius, $r_e$, of external guide 15 may be selected such that guide 15 is just below cut-off in the region of gap 23 for the $TE_{03}$ mode at the highest frequency in the operating range. Radius $r_i$ of the internal guide 13 is then readily determined so that the conductive boundary of guide 13 coincides with the electric field null of the $TE_{02}$ mode (see FIGS. 3*a* and 3*b*) supported in the external guide 15 along coupling gap 23, i.e., with $r_e$ determined, $r_i$ is equal to $r_e$ multiplied by the ratio of the Bessel function constants of the $TE_{01}$ and $TE_{02}$ modes; thus $$r_i = (3.83/7.02) r_e$$

It may be noted that the electric vectors of the $TE_{01}$ and $TE_{02}$ modes are in phase within the ring-like transverse area corresponding to the input port but will be oppositely phased in the transverse area corresponding to the output port.

The $TE_{01}$ and $TE_{02}$ modes, as is well known in the art, have different phase constants. They will therefore continue propagating along the gap 23 in the direction of the plane conducting wall 19 at unequal velocities. Accordingly, the phase relationship of the two modes will change along the distance of the gap 23. The two modes will be reflected by the wall 19 and propagate back to the right hand end of the gap 23. The coupler is arranged to provide a complete transfer from the input port to the output port if the width of the gap 23 is selected such that the electric vectors of the two reflected modes are in phase within the transverse area corresponding to the output port; i.e. if the relationship between the two modes at the right-hand end of the gap 23 is exactly 180° out-of-phase from what it was at the beginning of the coupling region. This requires:

$$(\beta_1 - \beta_2)\, d = \frac{(2n-1)}{2}\pi$$

where $\beta_1$ is the phase constant of the $TE_{01}$ mode, $\beta_2$ is the phase constant of the $TE_{02}$ mode, d is the width of the gap, and n is an integer. Accordingly, the output port will be excited by the energy which initially excited the double pipe coaxial guide. Furthermore, the electric field pattern exiting the output port and propagating down the circular guide 13 will be of the $TE_{01}$ type. The electromagnetic energy propagating down the circular guide 13 to the right then interacts with the electron beam which also travels to the right along the circular guide 13.

In the above description of the operation of the coupler, the presence of the beam hole 21 in the wall 19 has been tacitly ignored. It is experimentally found that the optimum (for bandwidth and efficiency) dimensions are modified when the beam hole 21 is added. However, modification is slight for a small beam hole, and a very good coupler is obtained by decreasing the ratio of $r_i$ to $r_e$ slightly. In an actual model of the preferred embodiment for operation at a frequency of 35 GHz and having a beam hole 0.337 inches in diameter and 0.375 inches long, $r_i=(0.224/0.449)r_e$.

An important feature of the present invention is that the very long rectangular-to-circular taper is on the same side of the reflecting wall as the circular waveguide. Thus, there is no competition for space between the taper and the electron gun in order to couple microwaves in the proper direction. Accordingly, no constraints are placed on the size of the coupler by the dimensions of the gap, and the coupler can provide efficient coupling over a wide bandwidth.

It is desirable that the gyrotron-traveling wave amplifier be operated at a frequency whose wavelength is close to the cut-off wavelength of the inner waveguide 13. However, since this is also the cut-off wavelength of the coupler, the latter's efficiency will be low at the operating frequency. The problem is avoided, as shown in FIG. 1, by tapering inner waveguide 13 such that its radius decreases from $r_i$ at the right edge of the gap 23 to $r_g$ a short distance l inside the waveguide, to increase the cut-off wavelength of the coupler relative to that of the waveguide 13. A gradual taper is used to prevent reflections.

Therefore, it is apparent that a practical waveguide coupler for use in a gyrotron traveling wave amplifier is realized by the disclosed device. The coupler is efficient and capable of wideband operation as shown by experimental measurements. FIG. 4 is a plot of reflectance of the coupler in db versus frequency of operation for the above-mentioned model of the preferred embodiment. In this model, $r_e=0.449$ inches, $r_i=0.224$ inches, $r_g=0.210$ inches, $l\cong0.50$ inches, and $d\cong0.27$ inches. It will be seen that the coupler demonstrates at least 95% coupling over a least a 10% bandwidth at a center frequency of 36.5 GHz. In the figure, the cut-off wavelength of the waveguide 13 sharply defines the lower edge of the bandwidth at 34.3 GHz, while the upper end of the bandwidth response is caused by a gradually increasing influence of the beam hole 21.

Obviously many modifications and variations of the present invention are possible in light of the above teachings. Alternatives may include the usage of other circular modes or possibly rectangular modes. This coupler may also be used in other types of microwave amplifiers or beam-microwave interaction devices then GYRO-TWT's. It may also be used without the beam hole as simple a method of efficiently coupling to a waveguide near cut-off. The device is also a circular-to-rectangular converter if energy is fed into the circular guide at the right side and derived from the rectangular guide. It is therefore to be understood that within the scope of the appended claims the invention may be practiced otherwise than as specifically described.

What is claimed and desired to be secured by Letters Patent of the United States is:

1. A waveguide coupler for gyrotron traveling-wave amplifiers comprising:

a first section of hollow conductive waveguide;

a reflective-plane conducting wall spaced apart from an end of the first waveguide section a given distance to form a gap in the conductive boundary formed by the first waveguide section and the wall, the wall having a hole for passage of an electron beam;

the first waveguide section forming an output port of the coupler;

a second section of hollow conductive waveguide disposed external to and coaxial with at least a portion of the first waveguide section and extending to the wall to provide a conductive boundary surrounding the gap, the region between the second and first waveguide sections forming an input port of the coupler; and means for applying electromagnetic waves in a hollow pipe mode to the input port, the second waveguide section having a cut-off determining dimension $r_e$ proportioned to support first and second distinct hollow pipe modes in the region of the gap at the frequency of the applied waves, the first waveguide section having cut-off-determining dimensions $r_i$ proportioned to support the first mode to the exclusion of the second mode at the frequency of the applied waves.

2. The waveguide coupler recited in claim 1 wherein: the first and second modes have different phase constants.

3. The waveguide coupler recited in claim 1 wherein: the first and second waveguide sections have circular transverse cross sections;

the first mode is the $TE_{01}$ circular electric mode; and the second mode is the $TE_{02}$ circular electric mode.

4. The waveguide coupler recited in claim 3 wherein: the second waveguide section is proportioned to be slightly below cut-off for the $TE_{03}$ mode for frequencies within the range.

5. The waveguide coupler recited in claim 1 wherein: the inner wall of the first waveguide section is tapered near the gap.

6. A waveguide coupler for coupling rectangular mode electromagnetic energy to a circular waveguide and vice versa comprising:

a first section of circular waveguide having a radius, $r_i$;

a second section of waveguide flaring from a rectangular shape at one end to a circular shape at the other end having a radius $r_e$, the flared waveguide surrounding and in contact with the section of circular waveguide so that the circular ends of the waveguides are co-planar and form, in cross-section, a pair of concentric circles bounded by the walls of the waveguide sections;

a coupling section of circular waveguide closed by a reflecting surface at one end and having a radius $r_e$, the same as that of the circular end of the flared waveguide, the coupling section being affixed to the circular flared section so that it forms an extension thereof of length d, the radii $r_i$ and $r_e$ being selected so that the first section of waveguide supports only the $TE_{01}$ electric field mode, and the coupling section supports both the $TE_{01}$ and $TE_{02}$ electric field modes.

7. The waveguide coupler as recited in claim 6, wherein:

the coupling section length, d, is derived from the formula $$(\beta_1 - \beta_2)d = \frac{2n-1}{2}\pi$$

where $\beta_1$ is the phase constant for the $TE_{01}$ mode $\beta_2$ is the phase constant for the $TE_{02}$ mode and n is an integer.

* * * * *